United States Patent [19]

Battisti

[11] Patent Number: 4,818,168

[45] Date of Patent: Apr. 4, 1989

[54] DOCUMENT SUPPORT APPARATUS FOR THERMAL BINDING

[75] Inventor: Thomas T. Battisti, Buffalo Grove, Ill.

[73] Assignee: General Binding Corporation, Northbrook, Ill.

[21] Appl. No.: 116,548

[22] Filed: Nov. 4, 1987

[51] Int. Cl.[4] ..... B42C 9/00; B42C 7/00; B42D 3/00

[52] U.S. Cl. ..... 412/37; 412/8; 281/45

[58] Field of Search ..... 412/8, 11, 12, 21, 22, 412/31, 36, 37, 40, 41; 281/45; 156/202, 216

[56] References Cited

U.S. PATENT DOCUMENTS

| | | | |
|---|---|---|---|
| 2,572,243 | 10/1951 | Cashing et al. | 412/8 |
| 3,739,412 | 6/1973 | Card et al. | 412/8 |
| 3,788,921 | 1/1974 | Polit et al. | 412/8 |
| 3,925,126 | 12/1975 | Leatherman | 412/8 |
| 3,928,119 | 12/1975 | Sarring | 412/37 |
| 3,954,548 | 5/1976 | Polit | 412/37 |
| 3,956,057 | 5/1976 | Jung | 412/37 |
| 4,141,100 | 2/1979 | Domroe et al. | 412/37 |

*Primary Examiner*—Paul A. Bell
*Assistant Examiner*—Heyrana, Sr. Paul M.

[57] ABSTRACT

There is disclosed herein an apparatus for use in thermally binding documents. The apparatus includes a housing which defines a document receiving aperture. Biased supports are associated with the housing and in alignment with the aperture for compressing documents along an edge to be bound and for defining a predetermined binding position. A heater is associated with the housing and is positioned adjacent the predetermined position and support for heating the edge of the documents to be bound.

7 Claims, 2 Drawing Sheets

DOCUMENT SUPPORT APPARATUS FOR THERMAL BINDING

BACKGROUND OF THE INVENTION

This invention relates to a book binding system, and more particularly, to a support apparatus for a thermal binding machine.

There are several systems for binding documents, pages, covers, etc. together. In one system there is provided a curled plastic binder which has a backbone and curled fingers for engaging prepunched apertures in the documents and binding them together with the plastic binder.

Another system, useful in other applications, employs a thermal or heat-sealing process whereby document pages and covers are bound together along one edge using an adhesive strip so positioned to bind the edge when heated.

Not all documents, etc., have the same number of pages, and it is therefore desirable to bind documents of different thicknesses of material with the same machine. In a prior system there has been provided a slide mechanism to permit the binding system to adjust to different thicknesses.

It is desirable to thermally bind books of various thicknesses in one device without using the slide-type mechanism.

It is also desirable to compress the bound pages and adhesive so as to cooperate in binding the pages together.

These and other objects of this invention will become apparent from the following description and appended claims.

SUMMARY OF THE INVENTION

There is disclosed herein an improved thermal binding system which employs a flexible support system rather than the sliding adjustment system. In this system there is provided a housing which defines a book receiving slot. Associated with the slot are a pair of flexible document biasing support means for guiding the documents to a binding position and applying a compressive force to the documents thereat. A heating element is provided at the binding position for heating the document edge to be bound.

In a preferred embodiment the biasing means comprises a pair of plates which are secured at one end to said housing adjacent said slot and are free at the other end but biased toward each other at a predetermined binding position.

DESCRIPTION OF THE PREFERRED EMBODIMENT

Figure 1:
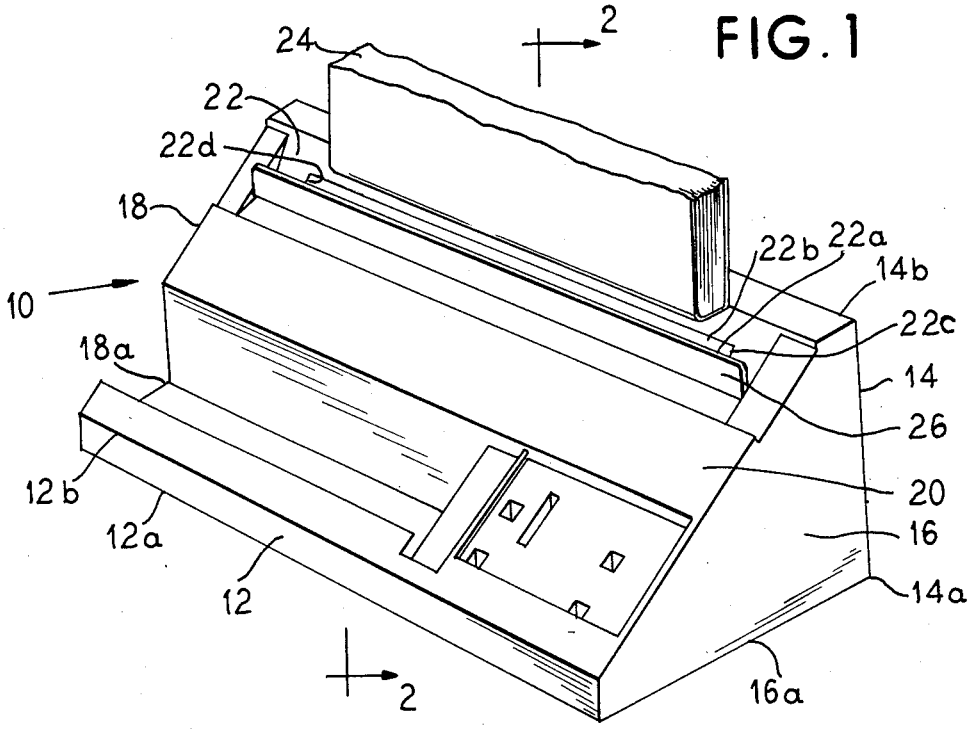
FIG. 1 is a perspective view of the housing for the thermal binding having a document receiving slot and documents positioned thereabove.

Referring now to the drawings, there is shown a housing 10 for use in a thermal binding machine for binding together documents, printed pages, covers, and the like. The housing is a unitary, molded member which can be shaped to include various depressions, holes, slots, etc., for controls and other devices for adjusting, timing, temperature, etc., but which do not directly affect the invention herein. The features of this invention are disclosed herein.

The housing includes a front plate 12, a larger back plate 14, a pair of upwardly sloping side plates 16 and 18, and an upwardly sloping front plate or front 20. The bottom edges of the front, back and side plates 12*a*, 14*a*, 16*a* and 18*a* define a base upon which the housing rests. The top edge 14*b* of the back plate defines a back edge. These edges cooperate in defining the slope of the face 20 and the front edge-to-base height is less than the back edge-to-base height.

The front face defines a document receiving slot 22 generally that extends transversely across the front face adjacent the back edge. A book or sheaf of documents 24 is shown positioned for insertion into the slot 22. The slot is defined by front and back edges 22*a* and 22*b* and side edges 22*c* and 22*d*. An upstanding guide or rail 26 is provided along the slot front edge 22*a* for use in guiding unbound documents into the slot 22.

Support members 28 and 30 generally are molded integral with the housing and adjacent the slot 22. The support members define a pair of plate-like members which extend toward the housing base that are shorter than the back edge-to-base height and which are biased toward each other so as to accommodate documents of various thicknesses and apply a compressive force on the documents at a binding position.

The forward support member 28 is molded integral with the housing adjacent the front edge 22*a* of slot 22, so as to secure the top end 28*a* of the support member to the housing. The body 28*b* is a flat plate-like member which extends transversely of the housing, parallel to the document receiving slot 22 and toward the housing base. The bottom end or edge 28*c* is free or unsecured and is constructed to move between a normal or binding position generally aligned with the longitudinal center line of the slot and an extended document engaging position.

The rearward support member 30 is secured to the housing adjacent the rearward edge 22*b* of the slot. This support member includes a plate having a substantially downwardly directed upper section 30*a* and a forwardly biased bottom section 30*b*. The upper section is secured to the housing at its top end 30*c* and extends downwardly to a transition line 30*d* at the junction of the upper and lower sections. The transition line 30*d* is generally horizontally aligned with the top edge 28*a* of the forward support member 28. The lower section of the support member defines a free end 30*e* and is sloped and biased toward the forward support member 28. The forward free end 28*c* and rearward free end 30*e* engage each other at a binding position and are aligned generally along a line parallel to the longitudinal center line for the slot 22. Together these bottom edges define a normal or binding position in which the bottom edges are biased toward each other and are separable, as shown by the dashed lines, to an alternative document engaging extended position. In the extended position the bottom free edges are separated from each other and the plates effectively hinge or swing about the connection to the housing or transition line as appropriate.

A heating element 32 is positioned adjacent the free ends 28*c* and 30*e* so as to cooperate in forming the normal or binding position. Heater controls for time, temperature, etc., are not shown but can be located on the front face 20.

The book 24 includes individual documents or pages 24a, covers 24b and 24c, and edge 24d to be bound. In the embodiment of this system, a U-shaped adhesive strip 34 is applied along the binding edge, usually the left-hand edge of a document. The adhesive bonds to the edges of the individual sheets and to the sides of the first and last sheets and the front and back covers.

In operation, an unbound book or document 24 ready for binding is inserted into the slot 22. It engages the support member or body 28b and bottom section 30b above the free ends and is pushed to the binding position adjacent the heater 32 and free ends 28c and 30e.

Figure 3:
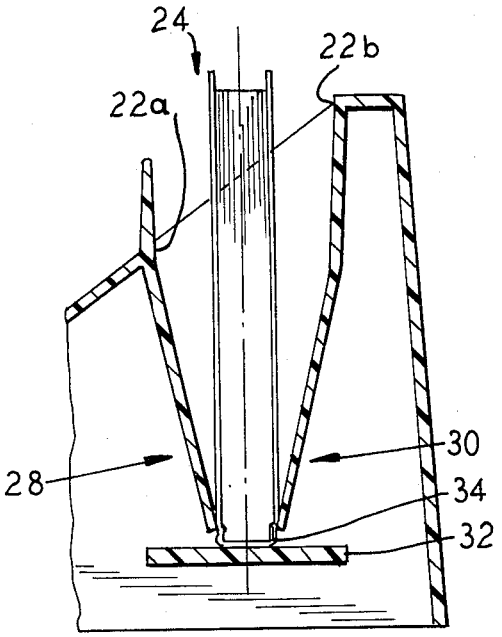
FIG. 3 is a vertical sectional view similar to FIG. 2, but showing the document in a binding position.

The free ends spread or separate to accommodate the book or document 24 and apply a compressive force to the binding edge as shown in FIG. 3. When the bound document is withdrawn, the compressive force of the free ends wipe the adhesive against the covers and the first and last pages in the last stages of binding.

Figure 2:
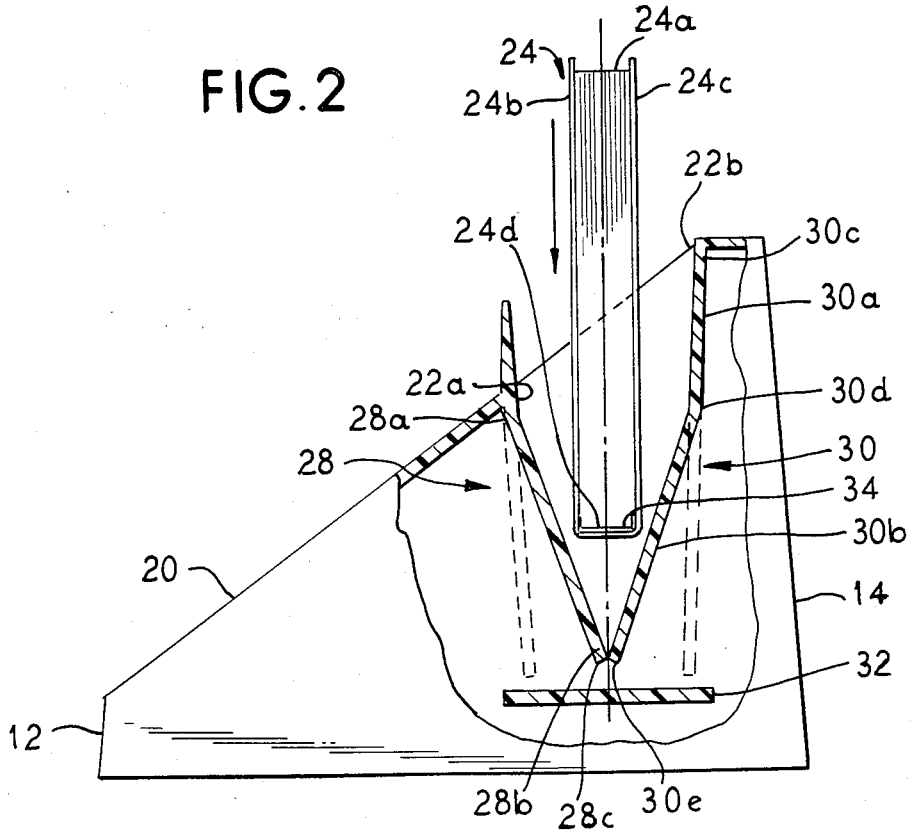
FIG. 2 is a vertical cross-sectional view along line 2—2 of the housing showing the documents for binding.
Figure 4:
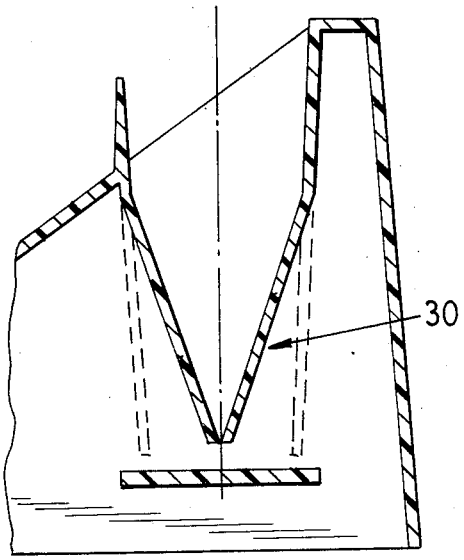
FIGS. 4, 5 and 6 are each vertical sectional views of slots and biasing means for books of different sizes.
Figure 5:
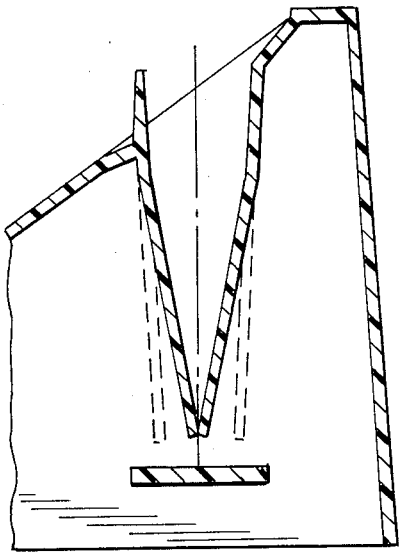
Figure 6:
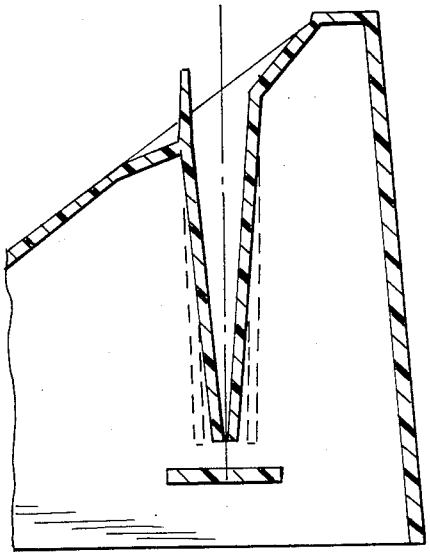

From FIG. 2, it is seen that the support plates are movable to extended positions to receive documents of various thicknesses. The support members are movable within a predetermined range. Slots and support members are provided for documents of thicknesses beyond the predetermined ranges, such as two inches as in FIG. 4, one inch as in FIG. 5, and one-half inch as in FIG. 6. Minor modifications are made in the constructions, such as the small depression forward of the guide rail positioning of the transition line depending on the thickness and the support wall construction.

Although the invention has been described with respect to preferred embodiments, it is not to be so limited as changes and modifications can be made which are within the full intended scope of the invention as defined by the appended claims.

I claim as my invention:

1. An apparatus for use in thermally binding documents, said apparatus including:

means defining a housing;

means associated with the housing which define a receiving aperture for receiving documents to be bound;

support means associated with said housing and aligned with the receiving aperture means for compressing documents together along the edge to be bound and for supporting documents in a predetermined position;

heating means associated with said housing and adjacent said predetermined positioning and support means for heating the edge of said documents to be bound;

said support means including a pair of spaced, downwardly extending support plate-like means which are biased toward each other for grasping documents therebetween;

said plate-like means including a pair of flexible plate members, each secured at one end to said housing adjacent said document receiving aperture and spaced from each other and each of the other ends being free and resiliently biased toward each other to cooperate in defining said predetermined position;

said plate-like means being constructed to converge from said document receiving end toward said binding end and form a V-like shape; and said housing means, said receiving aperture defining means and support means being unitary and formed of a plastic.

2. An apparatus as in claim 1, wherein each of said plate members is secured to said housing adjacent said receiving aperture defining means.

3. An apparatus as in claim 2, wherein said free ends of said plate means are separable so as to receive documents of various thicknesses therebetween and urge said documents together.

4. An apparatus as in claim 1, wherein said document receiving means define an elongated slot which extends substantially across the width of the housing.

5. An apparatus as in claim 3, wherein said biased free ends are constructed to engage said documents, urge said documents together and apply a compressive force on said documents at said predetermined binding position.

6. An apparatus for use in a thermal binding machine for binding documents along an edge comprising:

a unitary housing which includes:

a base;

a front face;

a back edge which is higher from the base than a front edge and which is elongated in the transverse direction;

a sloped face interconnecting the front face and back edge;

means defining an elongated transversely extending document receiving slot positioned in the front face closer to the back edge than the front edge;

a pivotal plate-like support means associated with said slot means and extending from said slot means toward said base, said plate-like support means each having a secured end adjacent said slot and a free end, each of said free ends biased toward each other so as to cooperate in defining a binding position, said plate-like support means defining a converging V-like shape, said free ends being separable so as to accommodate various quantities of documents therebetween and exert a compressive force thereon at said binding position; and heating means adjacent the free ends of said plate-like support means and positioned between said free ends and said base for cooperating in thermally binding said documents and in defining said binding position.

7. An apparatus as in claim 6, wherein there is further provided document guide means which comprise an upstanding guide element extending upwardly from said front face transversely thereof adjacent said slot and along the edge of said slot adjacent the front side edge of said slot means.

* * * * *